US010578374B2

(12) United States Patent
Baker et al.

(10) Patent No.: US 10,578,374 B2
(45) Date of Patent: Mar. 3, 2020

(54) FIN ENHANCEMENTS FOR LOW REYNOLDS NUMBER AIRFLOW

(71) Applicant: Brazeway, Inc., Adrian, MI (US)

(72) Inventors: Matt Baker, Onsted, MI (US); Scot Reagen, Sylvania, OH (US)

(73) Assignee: Brazeway, Inc., Adrian, MI (US)

( * ) Notice: Subject to any disclaimer, the term of this patent is extended or adjusted under 35 U.S.C. 154(b) by 3 days.

(21) Appl. No.: 15/689,597

(22) Filed: Aug. 29, 2017

(65) Prior Publication Data

US 2018/0058772 A1 Mar. 1, 2018

Related U.S. Application Data

(60) Provisional application No. 62/381,802, filed on Aug. 31, 2016.

(51) Int. Cl.
*F28F 1/32* (2006.01)
*F25B 39/00* (2006.01)
(Continued)

(52) U.S. Cl.
CPC ..... *F28F 1/325* (2013.01); *F25B 39/00* (2013.01); *F28D 1/0475* (2013.01); *F25B 39/02* (2013.01);
(Continued)

(58) Field of Classification Search
CPC .... F28F 1/34; F28F 1/325; F28F 1/128; F28F 1/105; F28F 1/126; F28F 13/12; F26B 39/00; F26B 39/02
(Continued)

(56) References Cited

U.S. PATENT DOCUMENTS 4,300,629 A 11/1981 Hatada et al.
4,550,776 A * 11/1985 Lu ..... F28F 1/325 165/151
(Continued)

FOREIGN PATENT DOCUMENTS

CN 1809721 7/2006
CN 101929767 12/2010
(Continued)

OTHER PUBLICATIONS

International Search Report completed Nov. 17, 2017 in counterpart international application No. PCT/US2017/049401.
(Continued)

*Primary Examiner* — Joel M Attey
(74) *Attorney, Agent, or Firm* — Harness, Dickey & Pierce, P.L.C.

(57) ABSTRACT

A heat exchanger including a plurality of parallel fins, and at least one tube passing through the parallel fins, wherein the tube carries a fluid that exchanges heat with air passing through the heat exchanger. The parallel fins each include a plurality of air deflecting members formed therein. Each air deflecting member is bent substantially orthogonally relative to a planar surface of each fin, and each air deflecting member is configured to direct the air passing through the heat exchanger to increase turbulence of the air, and to impinge the air against adjacent parallel fins, and to balance air flow across the heat exchanger and decrease maldistribution of the air flow through the heat exchanger.

8 Claims, 5 Drawing Sheets

(51) Int. Cl.

| | |
|---|---|
| ***F28F 13/12*** | (2006.01) |
| ***F28D 1/047*** | (2006.01) |
| *F28D 21/00* | (2006.01) |
| *F28F 1/12* | (2006.01) |
| *F28F 1/10* | (2006.01) |
| *F25B 39/02* | (2006.01) |

(52) U.S. Cl.
CPC ..... *F28D 2021/0071* (2013.01); *F28F 1/105* (2013.01); *F28F 1/126* (2013.01); *F28F 1/128* (2013.01); *F28F 13/12* (2013.01)

(58) Field of Classification Search
USPC ..... 165/181, 182, 183
See application file for complete search history.

(56) References Cited

U.S. PATENT DOCUMENTS 4,854,380 A * 8/1989 Yoshida ..... F28F 1/126 165/152
6,598,295 B1 7/2003 Utter
7,028,764 B2 * 4/2006 Reagen ..... F25B 39/02 165/144
7,231,965 B2 * 6/2007 Shimoya ..... F28D 1/05383 165/151
8,757,103 B2 * 6/2014 Cool ..... F24H 1/38 122/235.12
8,826,970 B2 * 9/2014 Shiraichi ..... F28F 1/32 165/151
2003/0196784 A1 * 10/2003 Utter ..... B21D 53/085 165/144
2004/0194936 A1 10/2004 Torii
2007/0051502 A1 3/2007 Yamauchi
2010/0243226 A1 9/2010 Huazhao et al.
2012/0103573 A1 5/2012 Hwang et al.

FOREIGN PATENT DOCUMENTS

JP S61147095 7/1986
JP H09264697 10/1997
JP 2000304484 11/2000
WO WO-2016-075666 A1 5/2016

OTHER PUBLICATIONS

Written Opinion of the International Searching Authority dated Nov. 17, 2017 in corresponding international application No. PCT/US2017/049401.
First Office Action issued by China Intelletual Property Administration dated Jan. 3, 2020, along with English translation thereof.

* cited by examiner

FIN ENHANCEMENTS FOR LOW REYNOLDS NUMBER AIRFLOW

CROSS-REFERENCE TO RELATED APPLICATIONS

This application claims the benefit of U.S. Provisional Application No. 62/381,802, filed on Aug. 31, 2016. The entire disclosure of the above application is incorporated herein by reference.

FIELD

The present disclosure relates to a heat exchanger having fin enhancements that is used in configurations where the airflow through the heat exchanger exhibits a low Reynolds number.

BACKGROUND

This section provides background information related to the present disclosure which is not necessarily prior art.

As illustrated in FIGS. 1 and 2, a conventional heat exchanger 10 of the plate fin-type generally include a plurality of parallel tubes 12 having a plurality of perpendicular fins 14. The plurality of perpendicular fins 14 are thermally coupled with a plurality of parallel tubes 12 to serve as an evaporator (heat exchanger 10). Heat absorbing fluid is forced through a capillary tube into the plurality of parallel tubes 12 at a low temperature and pressure. Subsequent evaporation of the fluid removes heat energy from the air passing adjacent the tubes of the evaporator, thus cooling the air. The fins 14 attached to the tubes 12 increase the effective heat absorbing area over which the airflow is directed, thus increasing the cooling efficiency of the evaporator. A small motor driven fan 16 may be utilized to draw air over the heat absorbing area of the evaporator and discharge the cooled air into the interior of the refrigerator.

It should be understood, however, that air flow distribution is affected by both the evaporator design and fan 16 placement. In many cases, a majority of the air flows directly under the fan 16 and less at the ends 18 of the heat exchanger 10, which results in a misdistribution of air flow that reduces heat transfer. This phenomenon is illustrated in FIG. 1.

Moreover, the tubes 12 of evaporator 10 are spaced evenly across the depth of the evaporator 10. However, for manufacturing and design purposes, this is often not the case. Thus, uneven gaps 20 between tubes 12 will disrupt the distribution of airflow, with more air flowing through the larger gaps as shown in FIG. 2. In this case, less air contacts the tubes 12, which decreases the amount of heat transfer.

Further, due to noise concerns, household refrigerators utilize small fans that yield lower airflow rates, with typical Reynolds numbers being in the range of 300 to 1200. These small fans are very sensitive to pressure drop and an increase in pressure drop can further reduce air flow, which degrades the amount of heat transfer. In addition, with this type of airflow, minimal improvement is seen from the traditional fin enhancements such as the use of louvers, rippled fins, and vortex generators. These types of enhancements perform best in configurations having higher Reynolds numbers, which represents the amount of turbulent flow that is used in many applications such as HVAC and commercial refrigeration, and is defined as follows:

$$Re=\rho V D_h/\mu \quad (1)$$

where $\rho$=density of air; V=air velocity; $\mu$=air viscosity; and $D_h$=hydraulic diameter, defined as $D_h=4\,A_{flow(min)}L/A_{surf}$, where $A_{flow(min)}$=the minimum cross sectional area the air flows through; L=the flow length of the evaporator; and $A_{surf}$=the surface area exposed to airflow.

SUMMARY

This section provides a general summary of the disclosure, and is not a comprehensive disclosure of its full scope or all of its features.

The present disclosure provides a heat exchanger including a plurality of parallel fins, and at least one tube passing through the parallel fins, wherein the tube carries a fluid that exchanges heat with air passing through the heat exchanger. The parallel fins each include a plurality of air deflecting members formed therein. Each air deflecting member is bent substantially orthogonally relative to a planar surface of each fin, and each air deflecting member is configured to redirect the air passing through the heat exchanger to force more air into contact with the tube evenly across the heat exchanger. In this manner, the maldistribution caused by the fan directing a majority of the airflow through the center is corrected to balance air flow throughout the heat exchanger to thereby increase heat transfer.

The present disclosure also provides a method for manufacturing a heat exchanger that includes providing a plurality of parallel fins; feeding a tube through the plurality of parallel fins; and mechanically fastening the tube to the parallel fins, wherein the step of providing a plurality of parallel fins includes stamping a plate that forms each fin to form a plurality of air deflecting members in each fin that are bent substantially orthogonally relative to a planar surface of each fin.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3:
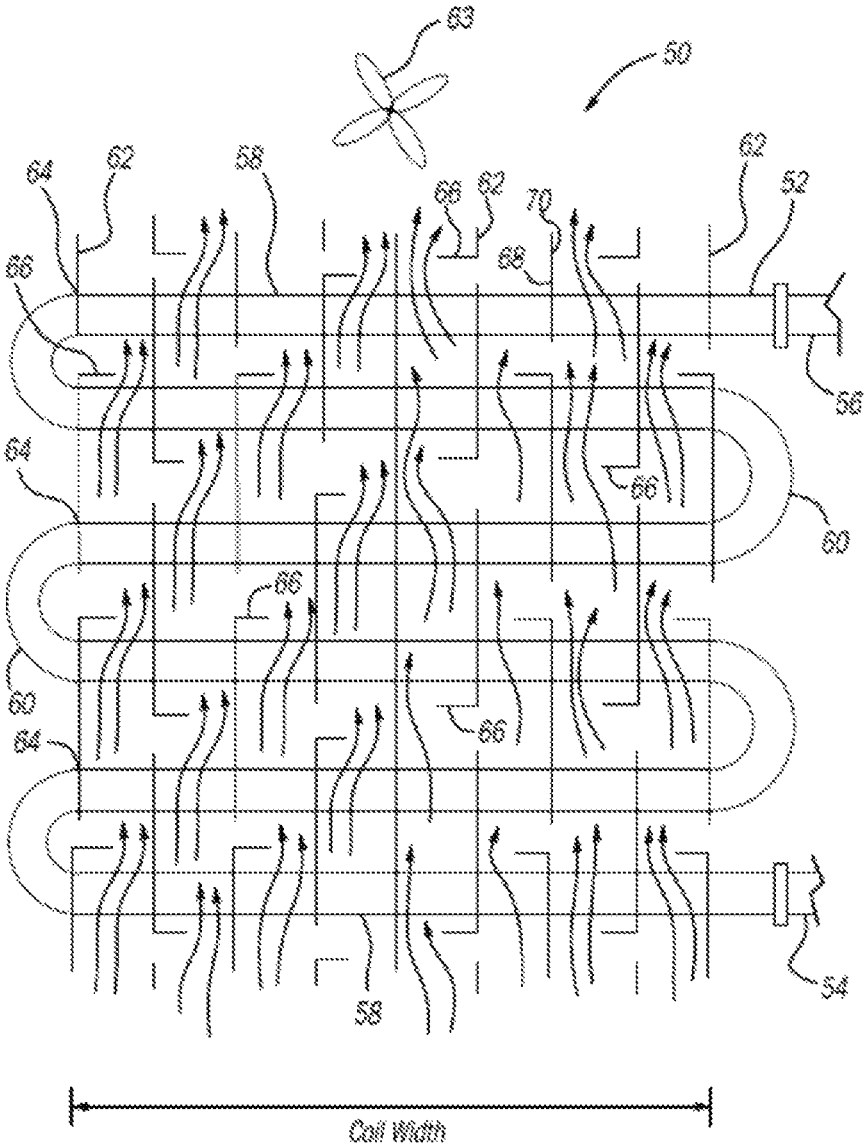
FIG. 3 is a front-perspective view of an example heat exchanger according to a principle of the present disclosure.
Figure 4:
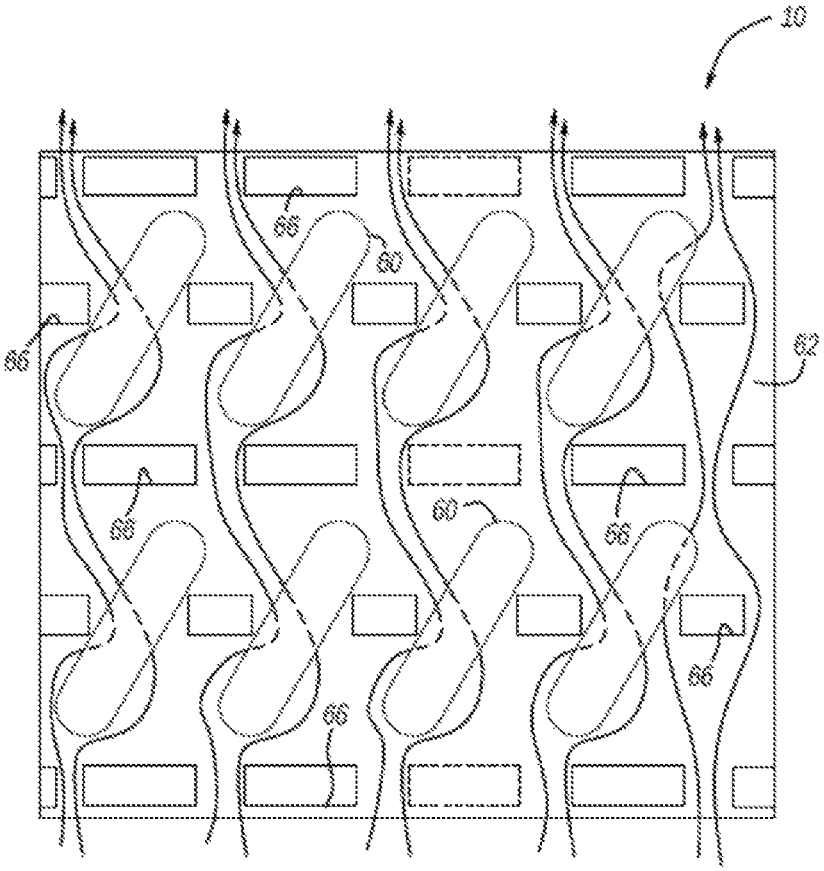
FIG. 4 is a side-perspective view of an example heat exchanger according to a principle of the present disclosure.
Figure 5:
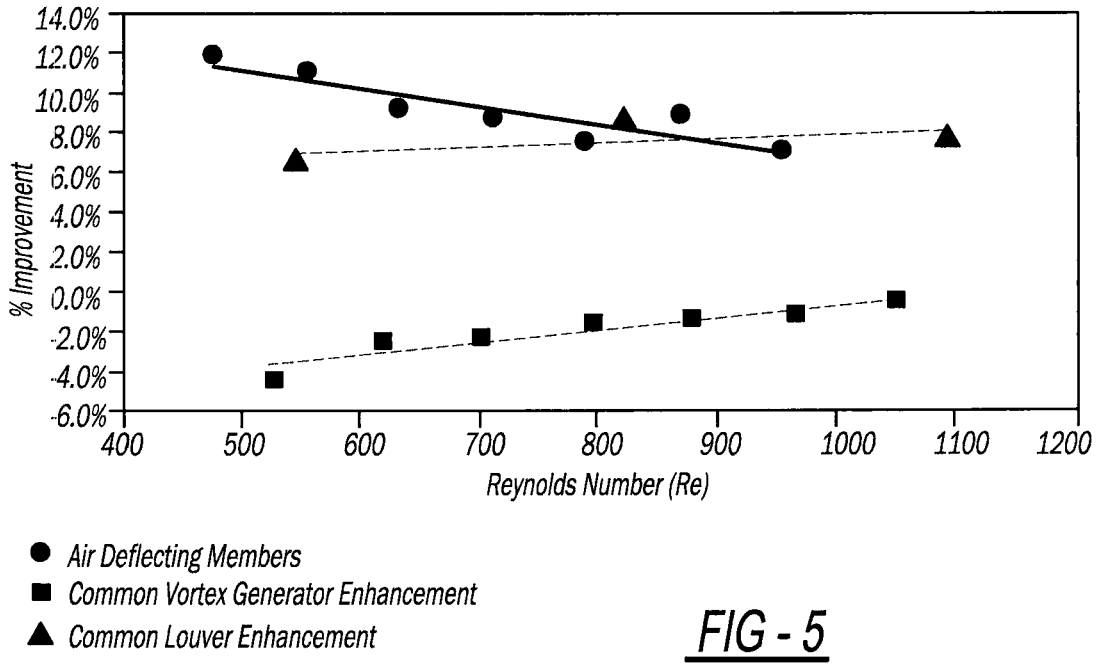
Figure 6:
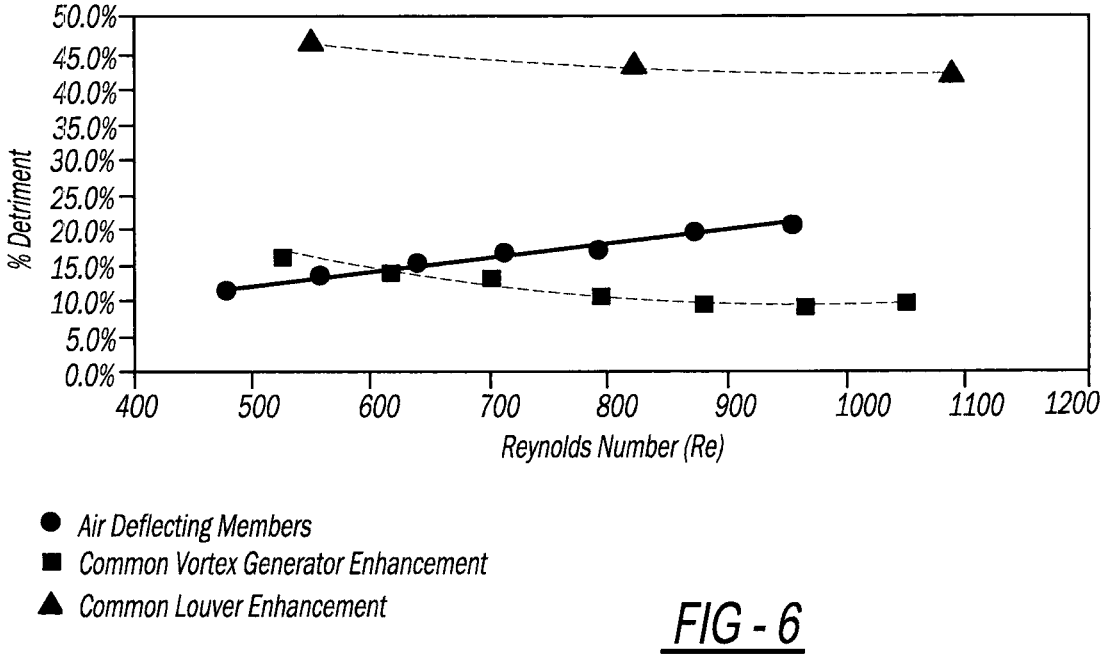

FIG. 5 graphically illustrates the amount of heat transfer improvement achieved by the example heat exchanger illustrated in FIGS. 3 and 4 in comparison to that achieved by conventional systems that use louvers or a vortex generator; and FIG. 6 graphically illustrates the impact on airside pressure drop achieved by the example heat exchanger illustrated in FIGS. 3 and 4 in comparison to that achieved by conventional systems that use louvers or a vortex generator.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to FIGS. 3 and 4, a heat exchanger or evaporator system 50 is schematically illustrated. Evaporator system 50 includes a tube 52 having both inlet 54 and an outlet 56 ends. Tube 52 is formed in a serpentine configuration including a plurality of elongated sections 58 that are separated by a plurality of reverse bends or hairpin 60. Elongated sections 58 and hairpins 60 may be unitary to form a continuous tube 52, or elongated sections 58 may be separately formed from hairpins 60 and subsequently brazed, welded, or mechanically fastened together. Tube 52 may be formed of any material such as copper, aluminum, stainless steel, titanium, or some other metal or alloy material that provides sufficient heat exchange with the surround air.

Fins 62 are metal plates formed of a material similar to or the same as tube 52. In this regard, fins 62 may be formed of materials such as copper, aluminum, stainless steel, or some other type of metal or alloy material that may be brazed, welded, or mechanically fastened to tube 52. Preferably, for cost purposes, fins 62 are formed of a material such as aluminum. To allow elongated sections 58 of tube 52 to pass through fins 62, fins 62 may include openings 64. As best shown in FIGS. 3 and 4, fins 62 each include a varying profile capable of dramatically enhancing the mixing of the air flow passing through evaporator system 50 and further capable of enhancing the impingement effect of air contacting each fin 62 and elongated sections 58 of tube 52. In this manner, the maldistribution of air flow through the heat exchanger 50 is corrected to evenly balance air flow through the heat exchanger 50. To assist in the flow of air passing through evaporator system 50, a fan 63 may be used.

Figure 1:
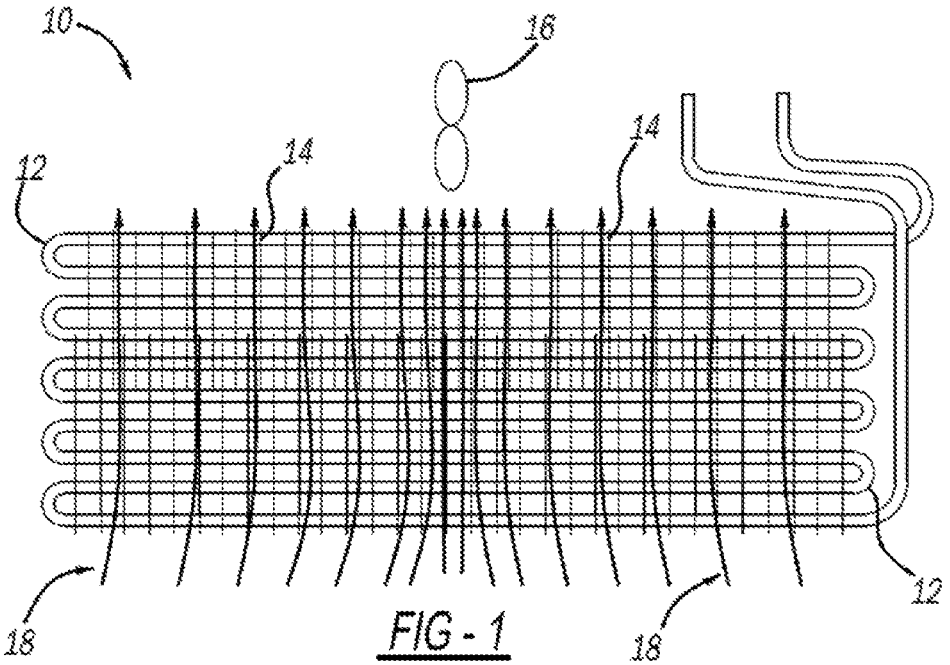
FIG - 1 Prior Art
FIG. 1 is a front-perspective view of a conventional heat exchanger.
Figure 2:
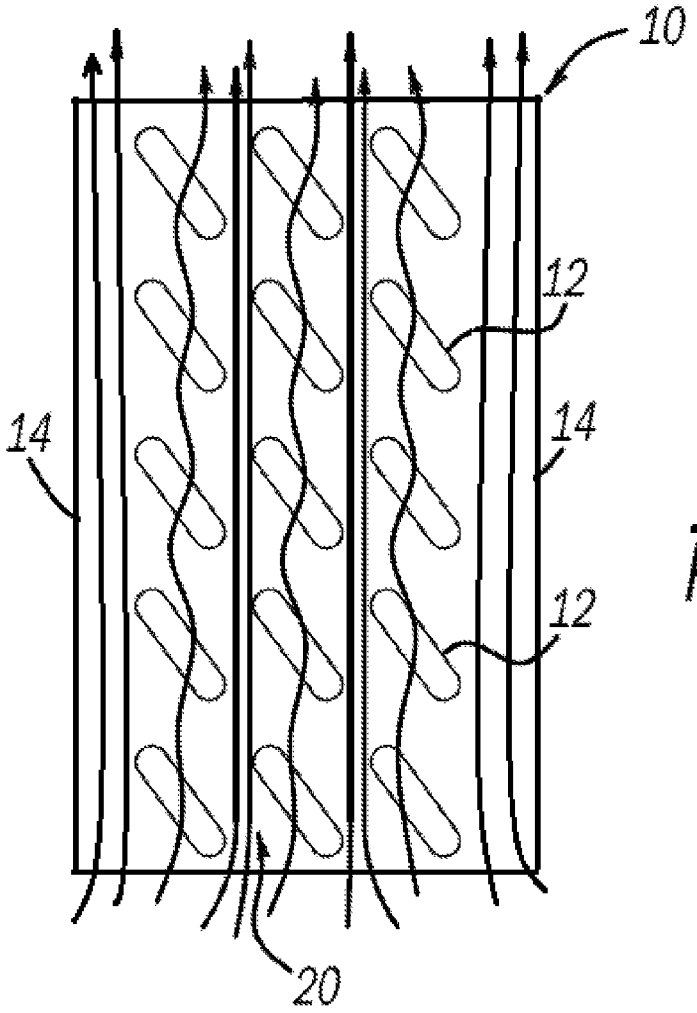
FIG - 2 Prior Art
FIG. 2 is a side-perspective view of a conventional heat exchanger.

More specifically, fins 62 may each be stamped to form openings 64, and to form a plurality of air deflecting members or tabs 66. Accordingly, fins 62 include a first surface 68 and an opposite second surface 70. Air deflecting tabs 66 are punched through fins 62 and bent relative to first and second surfaces 68 and 70 to a position that is substantially orthogonal to first and second surfaces 68 and 70. It should be understood, however, that air deflecting tabs 66 may be bent at any angle relative to first and second surfaces 68 and 70 that is desirable for directing air flow through evaporator system 50 in the desired manner. Regardless, as the number and placement of the air deflecting tabs 66 can be specifically tailored for each evaporator system 50, the uneven air flow illustrated in FIGS. 1 and 2 of the application can be effectively eliminated, or at least substantially minimized. Further, the use of air deflecting tabs 66 only slightly increases the possibility of a pressure drop on the air side of the system 50. That is, air deflecting tabs 66 equalize the pressure drop across the tube 52 balancing the air flow in the center of the tube 52 directly under the fan 63 to the edges of the tube 52 (i.e., to the left and right of FIGS. 3 and 4). The air deflecting tabs 66 also redirect the air flow from passing directly through the larger gaps between the bends 60 of tube 52 to paths that can pass underneath and around tube 52 (FIG. 4) to additionally increase heat transfer.

As shown in FIGS. 3 and 4, air deflecting tabs 66 are substantially rectangular or square members 66 that may be bent in a direction from first surface 68 toward second surface 70, or bent in a direction from second surface 70 toward first surface 68. Preferably, each air deflecting tab 66 of a respective fin 62 may be bent in the same direction for ease of manufacturing. It should be understood, however, that individual air deflecting tabs 66 of each fin 62 can be bent in different directions. It should also be understood that air deflecting tabs may be any shape known to one skilled in the art. For example, rounded or triangular-shaped air deflecting tabs 66 are contemplated. Further, it should be understood that air deflecting tabs 66 may be initially formed as having one shape (i.e., when initially stamped), and then modified to have a different shape using subsequent processing steps without departing from the scope of the present disclosure. For example, air deflecting tabs 66 may be slightly twisted in a helical or spiral manner to further assist in directing air flow between adjacent fins 62, or portions of individual tabs 66 may be removed to provide tabs 66 with a different shape than that originally formed by stamping.

A size of the air deflecting tabs 66 is variable, and may be selected based on a number of different factors including the size of the heat exchanger, a spacing between fins 62, a size of fan 63, and the like. In this regard, air deflecting tabs may have a surface area that ranges between 4 $mm^2$ (e.g., 2 mm×2 mm) to 196 $mm^2$ (e.g., 14 mm×14 mm). A preferred surface area of air deflecting tabs 66 is 24 $mm^2$ (6 mm×4 mm), which provides good heat transfer improvement for evaporator system 50, and is easily manufactured.

As air is drawn through fins 62 of evaporator system 50 by fan 63, the air deflecting tabs 66 direct the air in a back and forth manner to create a turbulent flow between adjacent fins 62. This effect is particularly advantageous at wider coil widths. The phrase "coil width" refers to a length of elongated sections 58 of tube 52, as shown in FIG. 3. At greater coil widths, a greater amount of air can be moved by tabs 66 to further increase heat exchange between evaporator system 50 and the air. Thus, as air is drawn through evaporator system 50, the air impinges the cooling fins 62 to increase the cooling effect and efficiency of evaporator system 50. Further, because air deflecting tabs 66 may be formed in the same manufacturing step as forming openings 64, the cost to manufacture fins 62 having air deflecting tabs 66 is reduced.

As best shown in FIG. 4, the air deflecting tabs 66 can be located between respective hairpins 60, behind the hairpins 60, or both. Further, air deflecting tabs 66 formed in different fins 62 can be offset, as shown by the air defecting tabs 66 illustrated in phantom. As shown in FIG. 3, half of the air deflecting tabs 66 can be oriented in one direction, and the remaining half of the air deflecting tabs 66 can be oriented in the opposite direction. Alternatively, air deflecting tabs 66 located near inlet 54 can be oriented in one direction (i.e., to the left in the figure), and air deflecting tabs 66 located near the outlet 56 can be oriented in the opposite direction (i.e., to the right in the figure). Another alternative is to have air deflecting tabs to the left and right of fan 63 be oriented in one direction, while tabs 66 located on fins 62 directly beneath fan 63 are oriented in an opposite direction. It should be understood that any number of combinations of orienting the air defecting tabs 66 can be selected such that specific applications can have specifically tailored configurations for the air defecting tabs 66 to maximize the air flow through heat exchanger 50. In any event, the air defecting tabs 66 reduce the flow area between fins 62, which increases air velocity between fins 62 and around the elongated sections 58 of tube 52 to increase heat transfer between the fluid in tube 52 and the air.

With such a configuration, the Reynolds number of the evaporator system 50 is reduced. While intuitively that would reduce heat transfer, the heat transfer coefficient is a function of both Reynolds number and hydraulic diameter:

$$Nu\ \alpha Re^{-0.5}=(\rho VD_h/\mu)^{-0.5} \quad (2)$$

Where Nu is the Nusselt number, and Nu=h $D_h$/k (where k is the thermal conductivity and h is the heat transfer coefficient). After substituting and reducing:

$$h\alpha(\rho VD_h/\mu)^{-0.5}K/D_h=(\rho V/(D_h\mu)^{-0.5}K \quad (3).$$

So, while the Nusselt number does reduce with reduced hydraulic diameter it is only by approximately a half power. Meanwhile, the heat transfer coefficient is proportional to a full inverted power of hydraulic diameter. Hence, reducing hydraulic diameter increases heat transfer coefficient.

Example

A complete evaporator system 50 was tested and the improvement in heat transfer measured. FIG. 5 shows the amount of heat transfer improvement relative to Reynolds Number, and shows the amount of heat transfer improvement when using conventional fin enhancements such as the use of louvers and vortex generators. As can be seen in FIG. 5, the amount of improvement of heat transfer achieved by the use of the air deflecting tabs 66 is better at lower Reynolds Numbers than that achieved using conventional fin enhancements such as louvers and vortex generators.

FIG. 6 illustrates the impact on airside pressure drop that occurs when using air deflecting tabs 66 according to the present disclosure, conventional louvers, and conventional vortex generators. As can be seen in FIG. 6, the use of deflecting tabs 66 is not detrimental to airside pressure drop in comparison to use of conventional louvers, and the amount of airside pressure drop that occurs using air deflecting tabs 66 is similar to that achieved by a conventional vortex generator. Although tabs 66 results in minimal airside pressure drop like the use of a vortex generator, it should be noted that the amount of heat transfer achieved by air defecting tabs 66 is substantially better than that achieved by a vortex generator as shown in FIG. 5.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat exchanger, comprising:

a plurality of parallel fins; and at least one tube of a serpentine configuration having a plurality of passes in an airflow path and passing through the parallel fins, the tube carrying a fluid that exchanges heat with air passing through the heat exchanger in the airflow path, wherein the parallel fins each include a plurality of air deflecting members that are tabs stamped therefrom such that each air deflecting member of each individual fin of the plurality of parallel fins is bent substantially orthogonally in the same direction relative to a planar surface of each fin and an aperture is formed in the fin at a location where a material of a respective parallel film that forms the air deflecting member was previously located, and each air deflecting member configured to direct the air passing through the heat exchanger; and wherein each of the fins air deflecting members are bent towards the center of the airflow path in a width direction of the of airflow path.

2. The heat exchanger according to claim 1, further comprising a fan for drawing air through the heat exchanger, wherein the tube has a plurality of elongated sections that are connected by a plurality of reverse bend sections, and each air deflecting member is configured to direct the air drawn through the heat exchanger by the fan.

3. The heat exchanger of claim 1, wherein the air deflecting members of one respective fin are bent in a first direction, and the air deflecting members of an adjacent fin are bent in a second and opposite direction.

4. The heat exchanger of claim 2, wherein the air deflecting members are formed between adjacent reverse bend sections of tube.

5. The heat exchanger of claim 2, wherein the air deflecting members are overlapped by the reverse bend sections of tube.

6. The heat exchanger of claim 2, wherein the air deflecting members are formed between adjacent elongated sections of tube.

7. The heat exchanger of claim 1, wherein air deflecting members of a respective fin are staggered relative to air deflecting members of an adjacent parallel fin.

8. The heat exchanger of claim 1, wherein air flow between adjacent parallel fins meanders between the parallel fins in a back and forth manner.

* * * * *